United States Patent [19]

Mattison

[11] Patent Number: 4,954,816

[45] Date of Patent: Sep. 4, 1990

[54] DECORATIVE SMOKE DETECTOR CONSTRUCTION

[76] Inventor: Lawrence A. Mattison, 388 N. Ellicott Creek Rd., Tonawanda, N.Y. 14150

[21] Appl. No.: 311,704

[22] Filed: Feb. 16, 1989

[51] Int. Cl.[5] ..... G08B 23/00

[52] U.S. Cl. ..... 340/693; 340/628

[58] Field of Search ..... 340/693, 628, 629

[56] References Cited

U.S. PATENT DOCUMENTS

| | | | |
|---|---|---|---|
| 4,075,614 | 2/1978 | White | 340/693 |
| 4,529,976 | 7/1985 | Jameson et al. | 340/693 |
| 4,623,878 | 11/1986 | Schoenwetter | 340/693 |
| 4,796,015 | 1/1989 | Admire, Jr. | 340/693 |

*Primary Examiner*—Joseph A. Orsino
*Assistant Examiner*—Geoff Sutcliffe
*Attorney, Agent, or Firm*—Joseph P. Gastel

[57] ABSTRACT

A decorative smoke detector construction which includes a smoke detector for mounting on a wall or ceiling of a room and which includes a decorative plaque mounted thereon which conceals the smoke detector from view and which includes structure for permitting communication of the smoke detector with smoke which may exist in the room. A kit for teaching fire safety including a package containing a decorative smoke detector construction as described above, and instructional literature which is especially attractive to children for teaching fire safety.

36 Claims, 4 Drawing Sheets

Fig. 8.
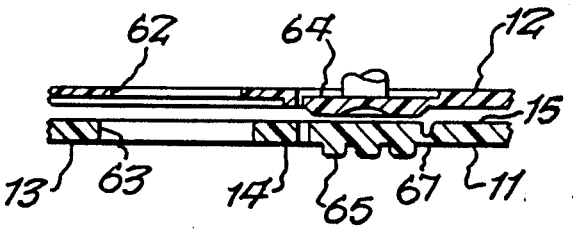
Fig. 9.
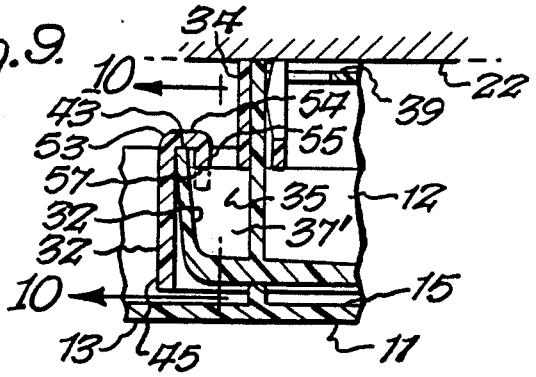
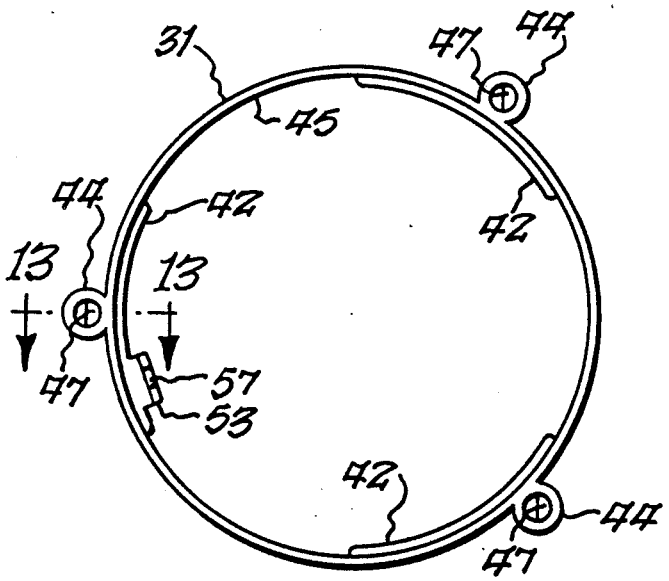
Fig. 12.
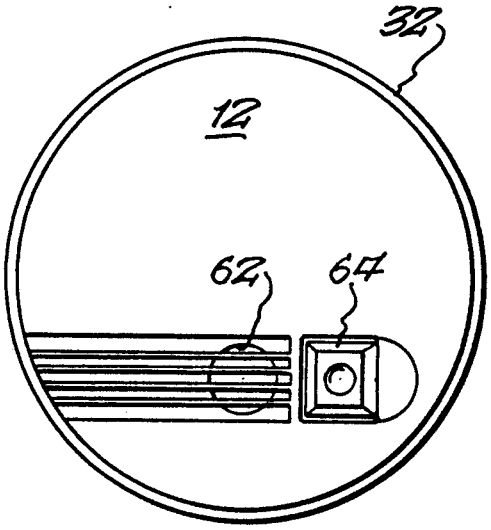
Fig. 11.
Fig. 14.
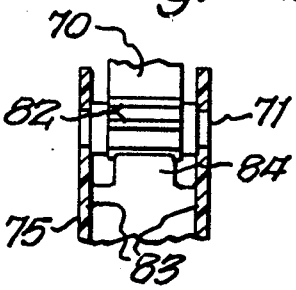
Fig. 10.
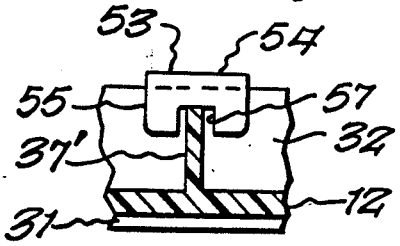
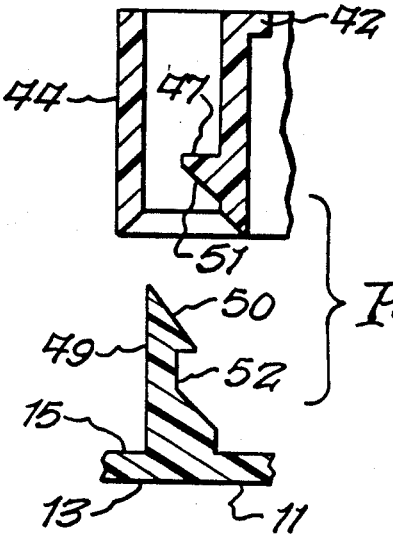
Fig. 13.
Fig. 15.
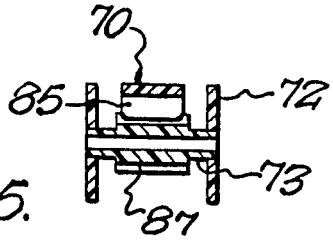

DECORATIVE SMOKE DETECTOR CONSTRUCTION

BACKGROUND OF THE INVENTION

The present invention relates to a decorative smoke detector construction consisting of a smoke detector and a decorative plaque mounted thereon.

By way of background, smoke detectors are either mounted on a ceiling or on a wall as far as 16 inches from the ceiling. Smoke detectors usually consist of the smoke detector itself within a outer casing. In the past, there has been a decorative smoke detector consisting of a smoke detector mounted on the front of a decorative back plate which was secured to the wall, but the smoke detector was exposed to view. The back plate of the prior smoke detector consisted of a comic character. However, in the foregoing smoke detector constructions, the smoke detector itself was exposed. Furthermore, the foregoing types of smoke detectors were not used in an instructional sense for the purpose of teaching fire safety, especially to children.

SUMMARY OF THE INVENTION

It is accordingly one object of the present invention to provide a decorative smoke detector construction which in addition to serving its smoke detecting function also decorates a room surface, such as a wall or ceiling.

Another object of the present invention is to provide an improved decorative smoke detector construction which is especially pleasing to children and which can especially be used in both decorating a child's room in addition to serving its primary function of smoke detection.

Yet another object of the present invention is to provide a decorative plaque which can be mounted on an existing previously installed smoke detector.

A further object of the present invention is to provide a kit which can be utilized for teaching fire safety and which includes a decorative smoke detector construction packaged with fire prevention literature which is especially attractive to children. Other objects and attendant advantages of the present invention will readily be perceived hereafter.

The present invention relates to a smoke detector construction for mounting relative to a room surface comprising a decorative plaque having a main body portion with an outer decorative side and an inner side, a smoke detector having an inner side and an outer side, locating means for locating said outer side of said smoke detector facing said inner side of said decorative plaque, and mounting means for mounting said decorative plaque and said smoke detector relative to an associated room surface with said outer side of said decorative plaque facing away from said surface whereby said outer side of said smoke detector is substantially visually obscured by said decorative plaque.

The present invention also relates to a decorative plaque for mounting on an existing smoke detector having an audible alarm and test means therefore comprising a body portion with an outer decorative side and an inner side, and means on said body portion for securing said body portion to said smoke detector with said inner side facing said smoke detector.

The present invention also relates to an instructional kit for teaching fire safety comprising a package, a decorative plaque and smoke detector combination within said package, and child-type or other instructional literature within said package pertaining to fire safety.

The various aspects of the present invention will be more fully understood when the following portions of the specification are read in conjunction with the accompanying drawings wherein:

BRIEF DESCRIPTION OF THE DRAWINGS

FIG. 8 is a fragmentary cross sectional view taken substantially along line 8—8 of FIG. 1 and showing the alignment between the audible alarm, test button and overlying portions of the plaque;

FIG. 9 is an enlarged fragmentary cross sectional view of the locating connection between the smoke detector and the retaining ring;

FIG. 10 is a fragmentary cross sectional view taken substantially along line 10—10 of FIG. 9;

FIG. 11 is a front elevational view of the face of the smoke detector;

FIG. 12 is a bottom plan view of the retaining ring;

FIG. 13 is an exploded enlarged fragmentary cross sectional view of a tubular portion of the retaining ring in spaced relationship to the post extending from the rear side of the ornamental plaque;

FIG. 14 is a fragmentary cross sectional view taken substantially along line 14—14 of FIG. 1;

FIG. 15 is a fragmentary cross sectional view taken substantially along line 15—15 of FIG. 1;

DESCRIPTION OF THE PREFERRED EMBODIMENTS

Figure 1:
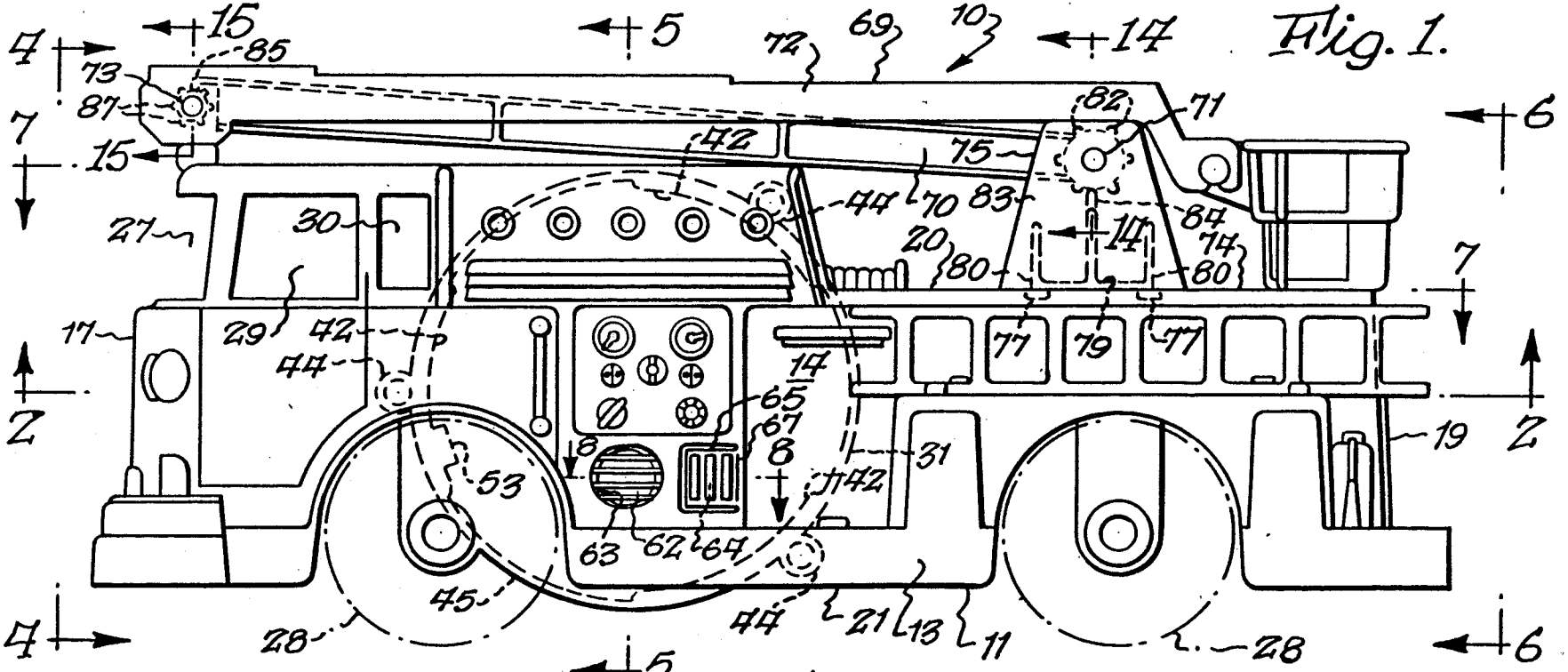
FIG. 1 is a side elevational view of the decorative smoke detector construction showing especially the outer side of the decorative plaque in the configuration of a fire engine.

The decorative smoke detector construction 10 of the present invention consists of a decorative plaque 11 mounted on a smoke detector 12. While the decorative plaque 11 is depicted as a fire engine, it will be appreciated that it can be of any desired object, such as a comic character, a clown, a person of any type, or any other subject matter which can be used as a decorative hanging for a wall, or in certain instances for a ceiling, either of the foregoing being considered a room surface. As is well known, smoke detectors may be mounted on a room wall within 16 inches of the ceiling or they may be mounted on the ceiling itself.

The decorative fire engine 11, which is fabricated of polypropylene, includes a main body portion 13 having an outer side 14 and an inner side 15 on which the smoke detector 12 is mounted. The decorative fire engine plaque 11 is also formed with a front edge portion 17 and a rear edge portion 19, both of which extend transversely to main body portion 13. A top edge 20 also extends transversely to main body portion 13. There is no transverse body portion adjacent the bottom edge 21 of main body portion 13. In other words, edge 21 (FIG. 5) is spaced from room wall surface 22 to permit any smoke which may exist in the room to move upwardly into the space between inner side 15 and wall 22 for communication with the smoke detector 12. It is also to be noted that edge 23 (FIGS. 4 and 6) of top edge portion 20 and edge 24 (FIG. 4) of side edge portion 17 and edge 25 (FIG. 6) of side edge portion 19 are all also spaced from wall 22 to permit flow of air and smoke toward smoke detector 12. Additionally, the fire engine configuration includes cutouts 27, 29 and 30 which depict windows of the fire engine and through which smoke can communicate with smoke detector 12. The fire engine also has wheels 28 which simulate rubber tires to give the fire engine a realistic look.

The smoke detector 12 is mounted on inner side 15 of plaque 11 by a molded polypropylene retaining ring 31. More specifically, the smoke detector 12 includes an outer cylindrical rim 32 and an inner cylindrical body portion 33 located within cylindrical wall 34. There is an annular space 35 between cylindrical walls 32 and 34 through which smoke can enter the smoke detector. A plurality of radial flanges 37 and 37' extend between walls 32 and 34. Cylindrical portion 34 terminates at a substantially planar wall 39 and a battery 40 is positioned within a cavity 41 with the outer side of the battery substantially flush with wall 39.

Figure 2:
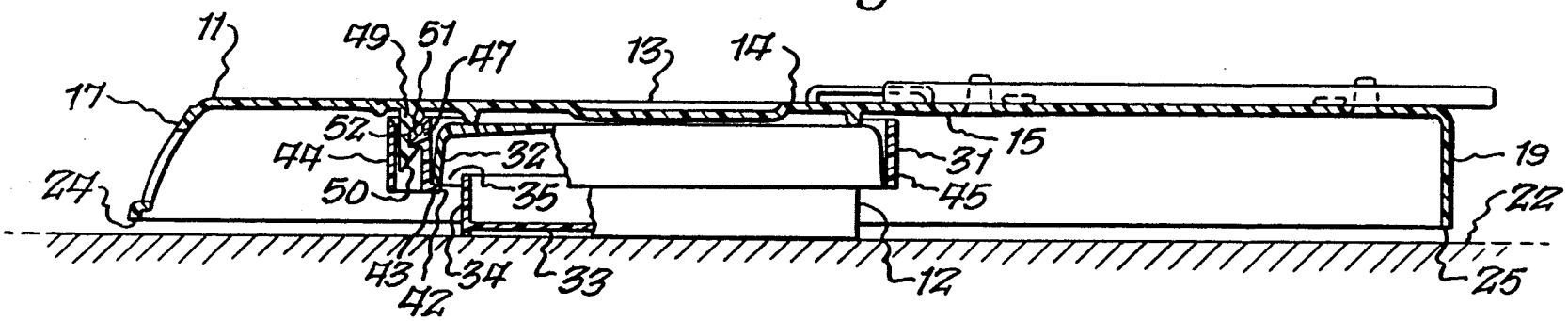
FIG. 2 is a cross sectional view taken substantially along line 2—2 of FIG. 1.
Figures 3, 4, 5, 6, 7:
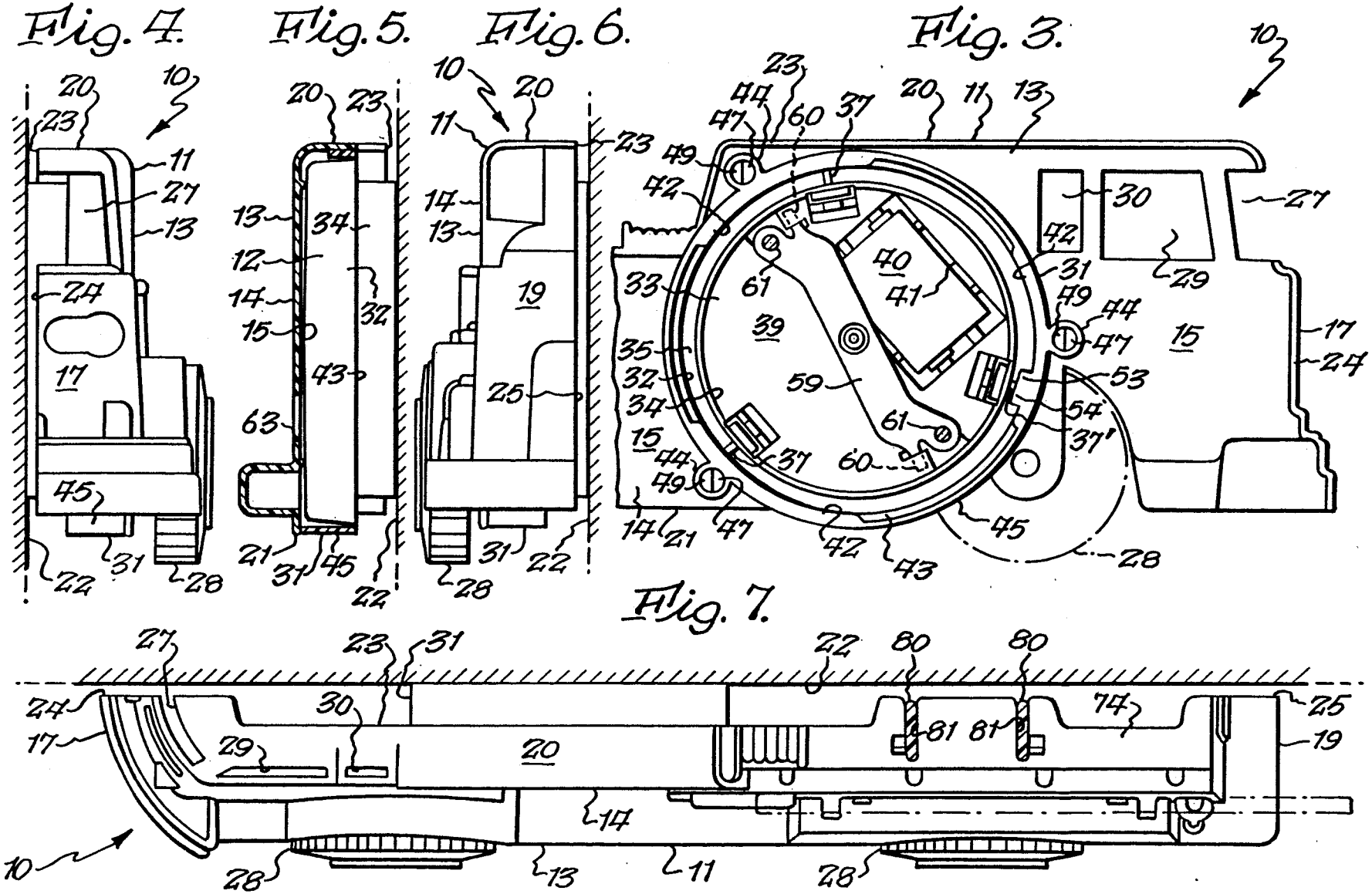
FIG. 3. is a fragmentary side elevational view of the inner side of the decorative plaque showing the smoke detector mounted thereon.
FIG. 4 is an end elevational view taken substantially in the direction of arrows 4—4 of FIG. 1.
FIG. 5 is a cross sectional view taken substantially along line 5—5 of FIG. 1 and showing the smoke detector in mounted position on the decorative plaque.
FIG. 6 is an end elevational view taken substantially in the direction of arrows 6—6 of FIG. 1.
FIG. 7 is a view, partially in cross section, taken substantially along line 7—7 of FIG. 1.

Retaining ring 31 holds the decorative plaque in position in the following manner. A plurality of circumferentially spaced flanges 42 on rim 45 overlie the circumferential edge 43 of smoke detector rim 32 (FIGS. 2 and 3). A plurality of cylindrical sockets 44 are formed integrally with rim 45 of the retaining ring. Each of these sockets includes a barb or detent 47 (FIG. 2). A plurality of posts 49 are formed integrally with and extend outwardly from inner side 15 of the plaque. As can be seen from FIG. 2, each post 49 has an inclined surface 50 over which inclined surface 51 of detent 47 can slide until detent 47 is retained within recess 52 of the post 49.

The smoke detector 12 must be oriented on inner side 15 as shown in FIG. 3 in order to cause fire engine 11 to assume a horizontal attitude when mounted on the wall 22. To this end, retaining ring 31 includes a construction shown in FIGS. 3, 9, 10 and 12. This construction consists of a locating tab 53 having an upper portion 54 and a downwardly extending portion 55 having a slot 57 therein in which the specific radial flange 37' is received. It is to be noted that tubular members 44 are unequally spaced on rim 45, and thus rim 45 can be mounted on side 15 only in one position. This being the case, tab 53 can only be located in the position shown in FIG. 3 when rim 31 is mounted thereon. Since the specific flange 37' shown in FIG. 3 is received within slot 57, the smoke detector 12 must be oriented relative to plaque 11 as shown.

The orientation of smoke detector 12 on plaque 11, as shown in FIG. 3, serves two purposes. First of all, when mounting bracket 59 is secured to wall 22 in the attitude shown in FIG. 3, tabs 60 at the ends of bracket 59 will be received under side or surface 39 of the smoke detector in the conventional manner to thereby orient the fire engine plaque 11 in the desired horizontal attitude. Bracket 59 is secured to wall 22 by screws 61. The foregoing mounting is well known in the industry. It is to be noted that slot 57 is oversize relative to flange 37'. Thus, even though retaining ring 31 is fixed relative to inner side 15, and even though the smoke detector 12 may be securely attached to the wall by the use of bracket 59, there can be relative movement of flange 37' within slot 57 so as to effect minor adjustments of attitude of the fire engine on the wall.

The second reason for orienting the smoke detector 12 relative to plaque 11 in the attitude shown in FIG. 3 is to cause the horn or audible alarm opening 62 in the nature of a grille (FIG. 1) of the smoke detector to be aligned with hole 63 in plaque main body portion 13 and also cause the test button 64 of the smoke detector to be positioned directly behind tab 65 of main body portion 13 which is secured to the remainder of the main body portion by a living hinge 67. Thus, in the event that the audible alarm or horn of the smoke detector sounds, the hole 63 permits the horn opening 62 of the smoke detector to be unobstructed so that any sound emanating therefrom will not be muffled. In addition, tab 65 conceals the test button while permitting it to be utilized.

The ring 31 is a convenient way of mounting the smoke detector 12 on decorative plaque 11. However, it will be understood that there are other ways of mounting the smoke detector on the decorative plaque which include other types of mounting members, gluing, clipping, or any other suitable arrangement.

Figure 16:
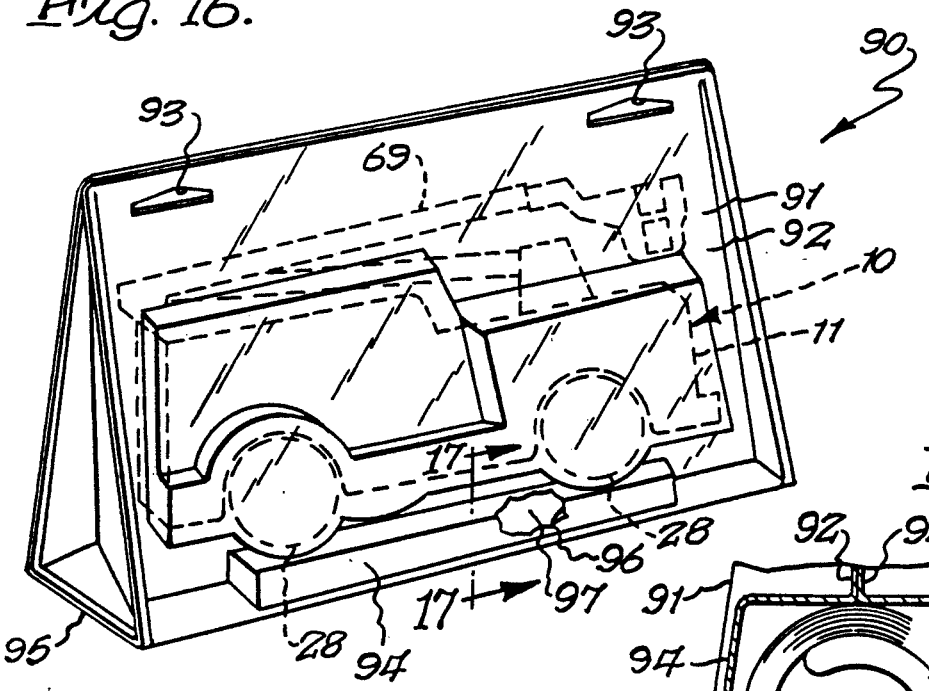
FIG. 16 is a diminitive perspective view of the fire safety kit including the package, the fire engine therein, and the instructional literature therein.
Figure 17:
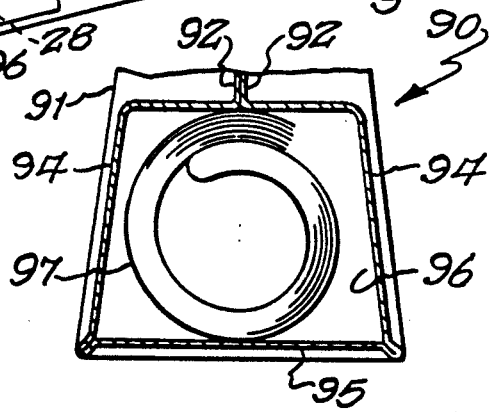
FIG. 17 is a fragmentary cross sectional view taken substantially along line 17—17 of FIG. 16 and showing the coiled instructional literature within a compartment of the package.

In the specific decorative plaque shown in the drawing, which is in the configuration of a fire engine, a snorkle 69 is shown in a retracted position. However, once it is mounted on the wall, the snorkle 69 can be extended by rotating link 70 in a clockwise direction about its pivot 71 and rotating link 72 in a counterclockwise direction about its pivot 73. The snorkle 69 is mounted on the top surface 74 (FIGS. 1 and 7) by means of a bracket 75 having feet 77 at the end of portion 79 and at the bottom of side portions 80 which are received in slots 81 in surface 74. Bracket 75 includes a pair of identical sides 83 between which tab 84 extends, the outer flexible edge of which is located adjacent ratchet member 82 fixed to link 70 so that when link 70 is pivoted in a clockwise direction, tab 84 will bear against one of the detents on ratchet 82 to hold link 70 in its adjusted position. Substantially the same construction is located at pivot 73 between links 70 and 72 wherein a flexible tongue member 85 bears against ratchet 73 fixed to link 70 and which has detent members 87 thereon so that link 72 will be held in any position to which it has been moved when the flexible tab 85 is held in position against one of the detents 87. Thus links 70 and 72 may be moved to desired positions in which they are retained by "click stop" structures, which are a part of the present invention only insofar as they permit the fire engine to assume various configurations The fire safety kit 90 of the present invention is shown in FIGS. 16 and 17. It includes a transparent plastic package 91 of the configuration shown with the two opposite sides 92 being thermo-formed to receive the fire engine smoke detector 10 of the present invention. The package 91 may have openings 93 thereon so that it may be mounted on a rack. The thermo-formed sides 92 each merge into portions 94 which, in combination with the bottom 95, form a compartment 96 in which a coiled booklet 97 relating to fire safety is held.

Figure 18:
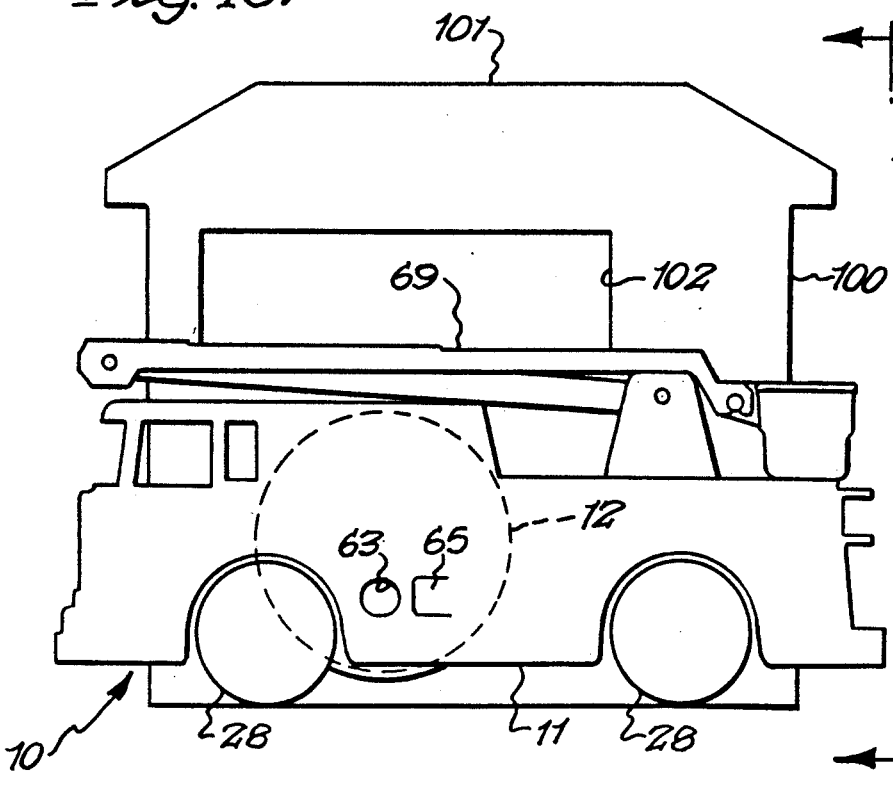
FIG. 18 is a front elevational view of a modified present invention including the above described fire engine and smoke detector assembly mounted on an ornamental back plate which in turn is mounted on the wall.
Figure 19:
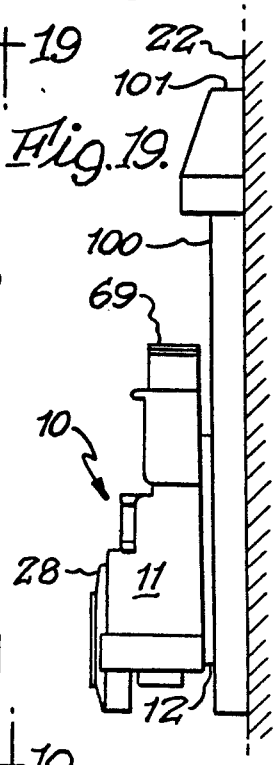
FIG. 19 is a fragmentary cross sectional view taken substantially in the direction of the arrows 19—19 of FIG. 18.

A modified embodiment of the present invention is disclosed in FIGS. 18 and 19 wherein the decorative fire engine plaque and its associated smoke detector 12, as described above in FIGS. 1–15, are mounted on a rear plate 100 which is in the shape of a fire house having a roof 101 and a doorway 102. The rear plate 100 is mounted on a wall 22 in any suitable manner as with screws or the like and the bracket 59 (FIG. 3) is attached thereto by screws 61 and the smoke detector 12 with plaque 11 mounted thereon is assembled onto bracket 59. Thus, the combination of the fire engine 11 and the back plate 100 give even more of a 3-dimensional effect. It will be appreciated that any type of ornamental plaque which is attached to the smoke detector 12 can be mounted on any desired back plate to thereby embellish its ornamental effect.

While the above description has referred to tab 65 for actuating a test button 64, certain smoke detectors have a photocell instead of a test button for testing the alarm when a flashlight beam is directed at the photocell. Accordingly, the decorative plaque can have an opening overlying the photocell rather than the above-described tab 65.

In addition, while the above description was directed to a decorative plaque for mounting on an existing smoke detector, it is contemplated that the decorative plaque can be an integral part of the smoke detector cover.

While the above description has shown the combination of a smoke detector and a decorative plaque, it will be appreciated that the decorative plaque can exist as an item separate from the smoke detector, and thus can be a separate article of commerce for mounting on previously installed smoke detectors. In the event that the previously installed smoke detector is located on a ceiling, the decorative plaque can be of any configuration and may represent any item which is compatible with ceiling mounting, such as an animal or insect crawling on the ceiling, or an airplane, or a celestial body, or any other item which is desired.

It can thus be seen that the decorative smoke detector construction of the present invention is manifestly capable of achieving the above enumerated objects and while preferred embodiments of the present invention have been disclosed, it will be appreciated that it is not limited thereto but may be otherwise embodied within the scope of the following claims.

What is claimed is:

1. A smoke detector construction for mounting relative to a room surface comprising a smoke detector having an inner side for facing said room surface and an outer side for facing away from said room surface, a decorative plaque having a main body portion with an outer side and an inner side with said inner side of said decorative plaque facing said outer side of said smoke detector, outer edges on said main body portion, mounting means mounting said decorative plaque on said smoke detector with said main body potion spaced from said room surface, and transverse edge portion means on said decorative plaque extending transversely to said main body portion for providing concealment to said smoke detector and causing said decorative plaque to be three-dimensional, said transverse edge portion means being located laterally outwardly from and overlying said mounting means.

2. A smoke detector construction as set forth in claim 1 wherein said smoke detector includes an audible alarm means, and means on said decorative plaque for maintaining said audible alarm means effectively unobstructed.

3. A smoke detector construction as set forth in claim 2 wherein said audible alarm means faces outwardly from said outer side of said smoke detector, and wherein said means on said decorative plaque for maintaining said audible alarm means effectively unobstructed comprises an opening in said decorative plaque proximate said audible alarm means for permitting an audible alarm to project therethrough.

4. A smoke detector construction as set forth in claim 3 wherein said opening comprises a grille extending between said inner and outer sides of said decorative plaque.

5. A smoke detector construction as set forth in claim 4 wherein said hole is in alignment with said audible alarm means.

6. A smoke detector construction as set forth in claim 1 including audible alarm test means on said smoke detector, and means on said decorative plaque for permitting access to said audible alarm test means.

7. A smoke detector construction as set forth in claim 6 wherein said audible alarm test means comprises a test button and wherein said last-mentioned means comprises a movable portion of said decorative plaque overlying said test button.

8. A smoke detector construction as set forth in claim 7 wherein said movable portion obscures said test button.

9. A smoke detector construction as set forth in claim 6 wherein said smoke detector includes an audible alarm means, and means on said decorative plaque for maintaining said audible alarm means effectively unobstructed while effectively visually obscuring said outer side of said smoke detector.

10. A smoke detector construction as set forth in claim 7 wherein said audible alarm means faces outwardly from said outer side of said smoke detector, and wherein said means on said decorative plaque for maintaining said audible alarm means effectively unobstructed comprises an opening in said decorative plaque proximate said audible alarm means for permitting an audible alarm to project therethrough.

11. A smoke detector construction as set forth in claim 10 wherein said opening comprises a hole extending between said inner and outer sides of said decorative plaque.

12. A smoke detector construction as set forth in claim 11 wherein said hole is a grille in alignment with said audible alarm means.

13. A smoke detector construction as set forth in claim 8 wherein said movable portion means comprises a tab on said decorative plaque overlying said test button.

14. A smoke detector construction as set forth in claim 13 wherein said decorative plaque is fabricated from plastic, and wherein said tab is connected to the remainder of said decorative plaque by a living hinge.

15. A smoke detector construction as set forth in claim 1 wherein said transverse edge portions extend only from certain but less than all of said outer edges of said main body portion.

16. A smoke detector construction as set forth in claim 15 wherein said room surface is a wall and wherein said outer edges of said main body portion include a lower outer edge, and wherein said transverse edge portion means do not exist at said lower outer edge to thereby permit smoke in said room to rise through the space between said lower outer edge of said main body portion and said wall.

17. A smoke detector construction as set forth in claim 1 wherein said main body portion is spaced a first distance from said room surface and wherein said transverse edge portion means include second outer edge portions which are to be spaced from said room surface a second distance which is smaller than said first distance, said second distance being sufficiently great to permit flow of air between said second outer edge portions and said room surface.

18. A smoke detector and decorative plaque combination for mounting relative to a room surface comprising a smoke detector having an inner side for facing said room surface and an outer side facing away from said room surface, a decorative plaque having a main body portion with an outer side facing away from said room surface and an inner side facing toward said outer side of said smoke detector, an outer cylindrical rim on said smoke detector having an edge for facing said room surface when said smoke detector is in mounted position, a retaining ring of larger diameter than said outer cylindrical rim for overlying said outer cylindrical rim, flange means on said retaining ring for engaging said edge of said outer cylindrical rim, a plurality of sockets formed on said retaining ring, a plurality of posts extending outwardly from said inner side of said plaque, said posts being spaced the same as said plurality of sockets, and interengaging means on said posts and in said sockets for retaining said posts in said sockets to thereby cause said flanges to bear on said edge of said outer cylindrical rim to retain said decorative plaque on said smoke detector with said inner side of said decorative plaque in contiguous relationship to said outer side of said smoke detector.

19. A smoke detector and decorative plaque combination as set forth in claim 18 wherein said decorative plaque includes a plurality of edges on said main body portion, a plurality of transverse edge portions extending inwardly from said edge portions toward said room surface a greater amount than the depth of said retaining ring to thereby conceal said retaining ring when viewed from outside of said transverse edge portions.

20. A smoke detector and decorative plaque combination for mounting on a room surface comprising a smoke detector having an inner side for facing said room surface and an outer side for facing away from said room surface, a decorative plaque having a main body portion with an inner side for facing said outer side of said smoke detector and an outer side facing away from said room surface, a central portion on said inner side of said decorative plaque, mounting means for mounting said main body portion of said decorative plaque on said smoke detector with said inner side of said decorative plaque facing said outer side of said smoke detector, said main body portion having outer edges which are located laterally outwardly beyond said smoke detector, and transverse edge portion means on said main body portion extending about a substantial portion of said central portion of said inner side of said decorative plaque for extending inwardly toward said room surface and including extreme outer edges which are sufficiently close to said room surface to conceal portions of said mounting means when viewed from outside of said transverse edge portions toward said smoke detector, said transverse edge portions being located laterally outwardly of said mounting means with open spaces between said transverse edge portions and said mounting means.

21. A smoke detector and decorative plaque combination as set forth in claim 20 wherein said main body portion is spaced a first distance from said room surface and wherein said transverse edge portion means include second outer edge portions which are to be spaced from said room surface a second distance which is smaller than said first distance, said second distance being sufficiently great to permit flow of air between said second outer edge portions and said room surface when said decorative plaque is mounted on said smoke detector and said smoke detector is mounted on said room surface.

22. A smoke detector and decorative plaque combination as set forth in claim 21 including a portion of said main body portion which does not include said transverse edge portion means and thus provides a space between said main body portion and said room surface to permit flow of air through said space to said smoke detector.

23. A smoke detector construction for mounting relative to a room surface comprising a first decorative plaque having a first front surface for facing away from said room surface and a first rear surface for facing said room surface, a smoke detector including a smoke detector housing mounted relative to said first decorative plaque, a second front surface on said smoke detector housing facing away from said first front surface, and a second decorative plaque mounted relative to said first decorative plaque and having a third front surface spaced from said first front surface and facing away from said second front surface, said first and second decorative plaques extending laterally outwardly beyond said smoke detector housing in a direction lengthwise of said room surface.

24. A smoke detector construction as set forth in claim 23 wherein said second decorative plaque includes transverse edge portions which extend toward said first plaque to overlie portions of said smoke detector between said first and second front surfaces and thus conceal said last-mentioned portions from view.

25. A smoke detector construction as set forth in claim 24 wherein said room surface is a vertical wall and wherein said second decorative plaque includes a top edge and a pair of side edges and a bottom edge, and wherein said transverse edge portions comprise at least one of said side edges of said second decorative plaque.

26. A smoke detector construction as set forth in claim 25 including a larger space between said bottom edge and said first front side than between said at least one of said side edges.

27. A smoke detector construction as set forth in claim 25 wherein said first front surface of said first decorative plaque includes portions which extend laterally outwardly beyond said third front surface of said second decorative plaque in a direction lengthwise of said room surface.

28. A smoke detector construction as st forth in claim 27 including transverse edge portions on said second decorative plaque extending toward said first surface.

29. A decorative smoke detector construction for mounting relative to a room surface comprising a first decorative plaque for mounting proximate a room surface, a second decorative plaque spaced from said first decorative plaque in a direction away from said room surface, a smoke detector including a smoke detector housing, and means mounting said smoke detector housing relative to said first and second decorative plaques and behind said second decorative plaque, said first and second decorative plaques extending laterally outwardly beyond said smoke detector housing in a direction lengthwise of said room surface.

30. A smoke detector and decorative plaque combination for mounting on a room surface comprising a smoke detector having an inner side for facing said room surface and an outer side for facing away from said room surface and a transverse outer periphery which extends transversely to said inner and outer sides of said smoke detector, a decorative plaque having a main body portion with an inner side for facing said outer side of said smoke detector and an outer side facing away from said room surface, mounting means for mounting said main body portion of said decorative plaque on said smoke detector with said inner side of said decorative plaque facing said outer side of said smoke detector, said main body portion having outer edges which are located laterally outwardly beyond said smoke detector, and transverse edge portion means on said main body portion extending about a substantial portion of said transverse outer periphery of said smoke detector and spaced therefrom for extending inwardly toward said room surface to conceal substantial portions of said mounting means and substantial portions of said transverse outer periphery of said smoke detector when viewed from outside of said transverse edge portion means.

31. A smoke detector construction as set forth in claim 1 wherein said outer side of said main body portion of said decorative plaque facing away from said room surface is three-dimensional in addition to the three-dimensional effect produced by said transverse edge portion means.

32. A smoke detector and decorative plaque combination as set forth in claim 20 wherein said outer side of said main body portion of said decorative plaque facing away from said room surface is three-dimensional.

33. A decorative smoke detector construction as set forth in claim 29 wherein said first and second decorative plaques have first and second outer sides facing away from said room surface, and wherein at least one of said first and second outer sides of said first and second decorative plaques is three-dimensional.

34. A smoke detector and decorative plaque combination as set forth in claim 30 wherein said outer side of said main body portion of said decorative plaque is three-dimensional.

35. A smoke detector and decorative plaque combination for mounting relative to a room surface comprising a smoke detector having an inner side for facing said room surface and an outer side facing away from said room surface, a decorative plaque having a main body portion with an outer side facing away from said room surface and an inner side facing toward said outer side of said smoke detector, an outer rim on said smoke detector having an edge for facing said room surface when said smoke detector is in mounted position, retaining means of larger dimension than said outer rim for overlying said outer rim, flange means on said retaining means for engaging said edge of said outer rim, a plurality of sockets formed on said retaining means, a plurality of posts extending outwardly from said inner side of said plaque, said posts being spaced the same as said plurality of sockets, and interengaging means on said posts and in said sockets for retaining said posts in said sockets to thereby cause said flanges to bear on said edge of said outer rim to retain said decorative plaque on said smoke detector with said inner side of said decorative plaque in contiguous relationship to said outer side of said smoke detector.

36. A smoke detector and decorative plaque combination as set forth in claim 35 wherein said decorative plaque includes a plurality of edges on said main body portion, a plurality of transverse edge portions extending inwardly from said edge portions toward said room surface a greater amount than the depth of said retaining means to thereby conceal said retaining means when viewed from outside of said transverse edge portions.

* * * * *

UNITED STATES PATENT AND TRADEMARK OFFICE

CERTIFICATE OF CORRECTION

PATENT NO. : 4,954,816

DATED : September 4, 1990

INVENTOR(S) : Lawrence A. Mattison

It is certified that error appears in the above-identified patent and that said Letters Patent is hereby corrected as shown below:

Column 2, line 55, after "modified" insert --form of the--.

Column 6, line 64 (claim 13), delete "means".

Column 8, line 66 (claim 27), change "25" to --23--.

Column 9, line 3 (claim 28), change "st" to --set--.

Signed and Sealed this

Eleventh Day of February, 1992

*Attest:*

HARRY F. MANBECK, JR.

*Attesting Officer*

*Commissioner of Patents and Trademarks*